US012188164B2

(12) United States Patent
Civanelli et al.

(10) Patent No.: US 12,188,164 B2
(45) **Date of Patent: *Jan. 7, 2025**

(54) COMBINATION WASHING/DRYING LAUNDRY APPLIANCE HAVING A HEAT PUMP SYSTEM WITH REVERSIBLE CONDENSING AND EVAPORATING HEAT EXCHANGERS

(71) Applicant: WHIRLPOOL CORPORATION, Benton Harbor, MI (US)

(72) Inventors: Claudio Civanelli, Travedona Monate (IT); Daniele Martinello, Besozzo (IT)

(73) Assignee: Whirlpool Corporation, Benton Harbor, MI (US)

( * ) Notice: Subject to any disclaimer, the term of this patent is extended or adjusted under 35 U.S.C. 154(b) by 288 days.

This patent is subject to a terminal disclaimer.

(21) Appl. No.: 17/686,019

(22) Filed: Mar. 3, 2022

(65) Prior Publication Data

US 2022/0186418 A1 Jun. 16, 2022

Related U.S. Application Data

(62) Division of application No. 16/691,816, filed on Nov. 22, 2019, now Pat. No. 11,299,834, which is a (Continued)

(51) Int. Cl.
*D06F 25/00* (2006.01)
*D06F 39/04* (2006.01)
(Continued)

(52) U.S. Cl.
CPC ..... *D06F 25/00* (2013.01); *D06F 39/04* (2013.01); *D06F 58/206* (2013.01); *F25B 13/00* (2013.01);
(Continued)

(58) Field of Classification Search
None
See application file for complete search history.

(56) References Cited

U.S. PATENT DOCUMENTS 2,515,825 A 7/1950 Grant
2,873,041 A 2/1959 Allen
(Continued)

FOREIGN PATENT DOCUMENTS

CN 101967746 2/2011
CN 105177914 12/2015
(Continued)

*Primary Examiner* — Levon J Shahinian
(74) *Attorney, Agent, or Firm* — Price Heneveld LLP

(57) ABSTRACT

An appliance air/water handling system includes a rotating drum, airflow and fluid paths for directing process air and fluid, respectively, therethrough. First and second heat exchangers are in direct engagement with the airflow and fluid paths, respectively. A reversible refrigerant circuit delivers refrigerant through the first and second heat exchangers to alternatively define washing and drying conditions. In the washing condition the first heat exchanger cools the process air into cooled process air, and the second heat exchanger heats the fluid to define a heated fluid that is directed into the drum. In the drying condition the first heat exchanger heats the process air to define heated process air that is directed through the drum and through a third heat exchanger, and the second heat exchanger cools the fluid to define a cooled fluid that is directed to the third heat exchanger intersect with the heated process air.

20 Claims, 8 Drawing Sheets

Related U.S. Application Data division of application No. 15/293,813, filed on Oct. 14, 2016, now Pat. No. 10,519,591.

(51) Int. Cl.

| | |
|---|---|
| ***D06F 58/02*** | (2006.01) |
| ***D06F 58/20*** | (2006.01) |
| ***D06F 58/22*** | (2006.01) |
| ***D06F 58/24*** | (2006.01) |
| ***F25B 13/00*** | (2006.01) |

(52) U.S. Cl.

CPC ..... *D06F 58/02* (2013.01); *D06F 58/22* (2013.01); *D06F 58/24* (2013.01); *F25B 2313/003* (2013.01); *F25B 2313/004* (2013.01)

(56) References Cited

U.S. PATENT DOCUMENTS 2,934,023 A 4/1960 Lamkin et al.
3,196,553 A 7/1965 Deaton et al.
3,218,730 A 11/1965 Menk et al.
3,342,961 A 9/1967 Deaton et al.
3,653,807 A 4/1972 Platt
3,805,404 A 4/1974 Gould
3,953,146 A 4/1976 Sowards
3,999,304 A 12/1976 Doty
4,134,518 A 1/1979 Menchen
4,137,647 A 2/1979 Clark, Jr.
4,860,921 A 8/1989 Gidseg
4,870,735 A 10/1989 Jahr, Jr. et al.
5,285,664 A 2/1994 Chang et al.
5,628,122 A 5/1997 Spinardi
5,666,817 A 9/1997 Schulak et al.
5,720,536 A 2/1998 Jenkins et al.
5,927,095 A 7/1999 Lee
5,946,934 A 9/1999 Kim et al.
5,979,174 A 11/1999 Kim et al.
6,041,606 A 3/2000 Kim
6,073,458 A 6/2000 Kim
6,401,482 B1 6/2002 Lee et al.
6,598,410 B2 7/2003 Temmyo et al.
6,793,010 B1 9/2004 Manole
6,957,501 B2 10/2005 Park et al.
6,973,799 B2 12/2005 Kuehl et al.
6,983,615 B2 1/2006 Winders et al.
7,055,262 B2 6/2006 Goldberg et al.
7,093,453 B2 8/2006 Asan et al.
7,117,612 B2 10/2006 Slutsky et al.
7,127,904 B2 10/2006 Schmid
7,143,605 B2 12/2006 Rohrer et al.
7,162,812 B2 1/2007 Cimetta et al.
7,181,921 B2 2/2007 Nuiding
7,254,960 B2 8/2007 Schmid et al.
7,504,784 B2 3/2009 Asada et al.
7,610,773 B2 11/2009 Rafalovich et al.
7,624,514 B2 12/2009 Konabe et al.
7,665,225 B2 2/2010 Goldberg et al.
7,707,860 B2 5/2010 Hong et al.
7,775,065 B2 8/2010 Ouseph et al.
7,866,057 B2 1/2011 Grunert et al.
7,895,771 B2 3/2011 Prajescu et al.
7,934,695 B2 5/2011 Sim et al.
7,980,093 B2 7/2011 Kuehl et al.
8,024,948 B2 9/2011 Kitamura et al.
8,056,254 B2 11/2011 Loffler et al.
8,074,469 B2 12/2011 Hamel et al.
8,079,157 B2 12/2011 Balerdi Azpilicueta et al.
8,099,975 B2 1/2012 Rafalovich et al.
8,104,191 B2 1/2012 Ricklefs et al.
8,166,669 B2 5/2012 Park et al.
8,182,612 B2 5/2012 Grunert
8,240,064 B2 8/2012 Steffens
8,245,347 B2 8/2012 Goldberg et al.
8,266,813 B2 9/2012 Grunert et al.
8,266,824 B2 9/2012 Steiner
8,276,293 B2 10/2012 Ricklefs et al.
8,377,224 B2 2/2013 Grunert
8,382,887 B1 2/2013 Alsaffar
8,438,750 B2 5/2013 Dittmer et al.
8,484,862 B2 7/2013 Nawrot et al.
8,572,862 B2 11/2013 TeGrotenhuis
8,601,830 B2 12/2013 Lee et al.
8,615,895 B2 12/2013 Shin et al.
8,656,604 B2 2/2014 Ediger et al.
8,667,705 B2 3/2014 Shin et al.
8,695,230 B2 4/2014 Noh et al.
8,770,682 B2 7/2014 Lee et al.
8,789,287 B2 7/2014 Kim et al.
8,789,290 B2 7/2014 Grunert
8,857,071 B2 10/2014 Lee et al.
8,910,394 B2 12/2014 Steffens
8,915,104 B2 12/2014 Beihoff et al.
8,984,767 B2 3/2015 Grunert et al.
9,010,145 B2 4/2015 Lim et al.
9,022,228 B2 5/2015 Grunert
9,027,256 B2 5/2015 Kim et al.
9,027,371 B2 5/2015 Beihoff et al.
9,052,142 B2 6/2015 Kim et al.
9,062,410 B2 6/2015 Ahn et al.
9,085,843 B2 7/2015 Doh et al.
9,103,569 B2 8/2015 Cur et al.
9,134,067 B2 9/2015 Ahn et al.
9,140,472 B2 9/2015 Shin et al.
9,140,481 B2 9/2015 Cur et al.
9,212,450 B2 12/2015 Grunert et al.
9,249,538 B2 2/2016 Bison et al.
9,299,332 B2 3/2016 Je
9,303,882 B2 4/2016 Hancock
9,328,448 B2 5/2016 Doh et al.
9,328,449 B2 5/2016 Doh et al.
9,334,601 B2 5/2016 Doh et al.
9,335,095 B2 5/2016 Bison et al.
9,356,542 B2 5/2016 Ragogna et al.
9,359,714 B2 6/2016 Contarini et al.
9,372,031 B2 6/2016 Contarini et al.
9,435,069 B2 9/2016 Contarini et al.
9,487,910 B2 11/2016 Huang et al.
9,534,329 B2 1/2017 Contarini et al.
9,534,340 B2 1/2017 Cavarretta et al.
9,605,375 B2 3/2017 Frank et al.
9,644,306 B2 5/2017 Doh et al.
9,663,894 B2 5/2017 Kim et al.
2004/0139757 A1 7/2004 Kuehl et al.
2005/0217139 A1 10/2005 Hong
2006/0070385 A1 4/2006 Narayanamurthy et al.
2006/0144076 A1 7/2006 Daddis, Jr. et al.
2006/0196217 A1 9/2006 Duarte et al.
2007/0033962 A1 2/2007 Kang et al.
2008/0141699 A1 6/2008 Rafalovich et al.
2008/0196266 A1 8/2008 Jung et al.
2008/0307823 A1 12/2008 Lee et al.
2009/0071032 A1 3/2009 Kreutzfeldt et al.
2009/0158767 A1 6/2009 McMillin
2009/0158768 A1 6/2009 Rafalovich et al.
2009/0165491 A1 7/2009 Rafalovich et al.
2009/0260371 A1 10/2009 Kuehl et al.
2009/0266089 A1 10/2009 Haussmann
2010/0011608 A1 1/2010 Grunert et al.
2010/0101606 A1 4/2010 Grunert
2010/0107703 A1 5/2010 Hisano et al.
2010/0146809 A1 6/2010 Grunert et al.
2010/0154240 A1 6/2010 Grunert
2010/0212368 A1 8/2010 Kim et al.
2010/0230081 A1 9/2010 Becnel et al.
2010/0258275 A1 10/2010 Koenig et al.
2010/0288471 A1 11/2010 Summerer
2011/0011119 A1 1/2011 Kuehl et al.
2011/0030238 A1 2/2011 Nawrot et al.
2011/0036556 A1 2/2011 Bison et al.
2011/0072849 A1 3/2011 Kuehl et al.
2011/0209484 A1 9/2011 Krausch et al.
2011/0209860 A1 9/2011 Koenig et al.
2011/0277334 A1 11/2011 Lee et al.

(56) References Cited

U.S. PATENT DOCUMENTS

| | | | |
|---|---|---|---|
| 2011/0280736 | A1 | 11/2011 | Lee et al. |
| 2012/0017456 | A1 | 1/2012 | Grunert |
| 2012/0266627 | A1 | 10/2012 | Lee |
| 2012/0272689 | A1 | 11/2012 | Elger et al. |
| 2013/0008049 | A1 | 1/2013 | Patil |
| 2013/0104946 | A1 | 5/2013 | Grunert et al. |
| 2013/0111941 | A1 | 5/2013 | Yu et al. |
| 2013/0212894 | A1 | 8/2013 | Kim et al. |
| 2013/0255094 | A1 | 10/2013 | Bommels et al. |
| 2013/0263630 | A1 | 10/2013 | Doh et al. |
| 2013/0276327 | A1 | 10/2013 | Doh et al. |
| 2013/0318813 | A1 | 12/2013 | Hong et al. |
| 2013/0340797 | A1 | 12/2013 | Bommels et al. |
| 2014/0020260 | A1 | 1/2014 | Carow et al. |
| 2014/0026433 | A1 | 1/2014 | Bison et al. |
| 2014/0075682 | A1 | 3/2014 | Filippetti et al. |
| 2014/0109428 | A1 | 4/2014 | Kim et al. |
| 2014/0190032 | A1 | 7/2014 | Lee et al. |
| 2014/0260356 | A1 | 9/2014 | Wu |
| 2014/0290091 | A1 | 10/2014 | Bison et al. |
| 2014/0366397 | A1 | 12/2014 | Wakizaka et al. |
| 2015/0033806 | A1 | 2/2015 | Cerrato et al. |
| 2015/0114600 | A1 | 4/2015 | Chen et al. |
| 2015/0308034 | A1 | 10/2015 | Cavarretta et al. |
| 2015/0322618 | A1 | 11/2015 | Bisaro et al. |
| 2016/0010271 | A1 | 1/2016 | Shin et al. |
| 2016/0040350 | A1 | 2/2016 | Xu et al. |
| 2016/0083894 | A1 | 3/2016 | Bison et al. |
| 2016/0083896 | A1 | 3/2016 | Ryoo et al. |
| 2016/0115636 | A1 | 4/2016 | Kim et al. |
| 2016/0115639 | A1 | 4/2016 | Kim et al. |
| 2016/0138208 | A1 | 5/2016 | Bison et al. |
| 2016/0138209 | A1 | 5/2016 | Kitayama et al. |
| 2016/0145793 | A1 | 5/2016 | Ryoo et al. |
| 2016/0169540 | A1 | 6/2016 | Hancock |
| 2016/0186374 | A1 | 6/2016 | Ryoo et al. |
| 2016/0258671 | A1 | 9/2016 | Allard et al. |
| 2016/0265833 | A1 | 9/2016 | Yoon et al. |
| 2016/0282032 | A1 | 9/2016 | Gomes et al. |
| 2016/0305696 | A1 | 10/2016 | Kobayashi et al. |

FOREIGN PATENT DOCUMENTS

| | | | |
|---|---|---|---|
| CN | 105696291 | | 6/2016 |
| DE | 3147796 | | 3/1983 |
| DE | 3738031 | A1 | 5/1989 |
| DE | 4304372 | A1 | 8/1994 |
| DE | 4409607 | | 10/1994 |
| DE | 10002742 | C1 | 6/2001 |
| DE | 10116238 | B4 | 3/2005 |
| DE | 10002743 | B4 | 1/2006 |
| DE | 102005041145 | A1 | 3/2007 |
| DE | 102006018469 | A1 | 10/2007 |
| DE | 102007052835 | A1 | 5/2009 |
| DE | 102008033388 | A1 | 1/2010 |
| DE | 102008054832 | A1 | 7/2010 |
| DE | 102009046921 | | 5/2011 |
| DE | 102012223777 | A1 | 6/2014 |
| DE | 112012006737 | T5 | 4/2015 |
| EP | 468573 | A1 | 1/1992 |
| EP | 0816549 | | 1/1998 |
| EP | 999302 | A1 | 5/2000 |
| EP | 1055767 | A1 | 11/2000 |
| EP | 1987190 | A1 | 11/2008 |
| EP | 2134896 | B1 | 12/2009 |
| EP | 2189568 | | 5/2010 |
| EP | 2202349 | | 6/2010 |
| EP | 2284310 | A1 | 2/2011 |
| EP | 2324152 | B1 | 5/2011 |
| EP | 2341178 | A1 | 7/2011 |
| EP | 2386679 | | 11/2011 |
| EP | 2455526 | A1 | 5/2012 |
| EP | 2466001 | | 6/2012 |
| EP | 2497856 | | 9/2012 |
| EP | 2559805 | A1 | 2/2013 |
| EP | 2581489 | A1 | 4/2013 |
| EP | 2612964 | A1 | 7/2013 |
| EP | 2612965 | A1 | 7/2013 |
| EP | 2612966 | A1 | 7/2013 |
| EP | 2634301 | | 9/2013 |
| EP | 2708636 | A1 | 3/2014 |
| EP | 2708639 | A1 | 3/2014 |
| EP | 2733257 | A1 | 5/2014 |
| EP | 2746455 | | 6/2014 |
| EP | 2594687 | | 9/2014 |
| EP | 2966215 | | 1/2016 |
| EP | 2993427 | A1 | 3/2016 |
| EP | 3015594 | A1 | 5/2016 |
| EP | 2468949 | | 6/2016 |
| EP | 3034675 | | 6/2016 |
| EP | 3241944 | | 11/2017 |
| GB | 2087029 | A | 5/1982 |
| JP | 2000018796 | | 1/2000 |
| JP | 2004053055 | | 2/2004 |
| JP | 2005027768 | | 2/2005 |
| JP | 2006017338 | | 1/2006 |
| JP | 2006187449 | | 7/2006 |
| JP | 2013019623 | A | 1/2013 |
| JP | 2013085687 | | 5/2013 |
| KR | 20100031929 | A | 3/2010 |
| NL | 7801958 | A | 8/1979 |
| WO | 8602149 | | 4/1986 |
| WO | 2004106737 | A1 | 12/2004 |
| WO | 2005001357 | A1 | 1/2005 |
| WO | 2005032322 | A2 | 4/2005 |
| WO | 2007013327 | A1 | 2/2007 |
| WO | 2007093461 | A1 | 8/2007 |
| WO | 2008077708 | A1 | 7/2008 |
| WO | 2008110451 | A1 | 9/2008 |
| WO | 2008151938 | A1 | 12/2008 |
| WO | 2009031812 | A2 | 3/2009 |
| WO | 2009059874 | A1 | 5/2009 |
| WO | 2009077226 | A1 | 6/2009 |
| WO | 2009077227 | A1 | 6/2009 |
| WO | 2009077291 | A1 | 6/2009 |
| WO | 2009089460 | A2 | 7/2009 |
| WO | 2010028992 | A1 | 3/2010 |
| WO | 2010040635 | A1 | 4/2010 |
| WO | 2010071355 | A2 | 6/2010 |
| WO | 2010102892 | A1 | 9/2010 |
| WO | 2010112321 | A1 | 10/2010 |
| WO | 2010118939 | A1 | 10/2010 |
| WO | 2011057954 | A2 | 5/2011 |
| WO | 2011061068 | A1 | 5/2011 |
| WO | 2012022803 | A1 | 2/2012 |
| WO | 2012065916 | A1 | 5/2012 |
| WO | 2012093059 | A1 | 7/2012 |
| WO | 2012101028 | A1 | 8/2012 |
| WO | 2012134149 | A2 | 10/2012 |
| WO | 2012138136 | A2 | 10/2012 |
| WO | 2013129779 | A1 | 9/2013 |
| WO | 2013144763 | A2 | 10/2013 |
| WO | 2013144764 | A1 | 10/2013 |
| WO | 2014001950 | A1 | 1/2014 |
| WO | 2014040923 | A1 | 3/2014 |
| WO | 2014041097 | A1 | 3/2014 |
| WO | 2014076149 | A1 | 5/2014 |
| WO | 2014095790 | A1 | 6/2014 |
| WO | 2014102073 | A1 | 7/2014 |
| WO | 2014102144 | A1 | 7/2014 |
| WO | 2014102317 | A2 | 7/2014 |
| WO | 2014102322 | A1 | 7/2014 |
| WO | 2014154278 | | 10/2014 |
| WO | 2015003742 | A1 | 1/2015 |
| WO | 2015028270 | A1 | 3/2015 |
| WO | 2015074837 | A1 | 5/2015 |
| WO | 2015082011 | A1 | 6/2015 |
| WO | 2015101386 | A1 | 7/2015 |
| WO | 2015101387 | A1 | 7/2015 |
| WO | 2015101388 | A1 | 7/2015 |
| WO | 2015101892 | A1 | 7/2015 |
| WO | 2015160172 | A1 | 10/2015 |
| WO | 2016006900 | A1 | 1/2016 |
| WO | 2016020852 | | 2/2016 |

(56) References Cited

FOREIGN PATENT DOCUMENTS

| | | |
|---|---|---|
| WO | 2016085432 | 6/2016 |
| WO | 2016095970 | 6/2016 |
| WO | 2016150660 A1 | 9/2016 |

COMBINATION WASHING/DRYING LAUNDRY APPLIANCE HAVING A HEAT PUMP SYSTEM WITH REVERSIBLE CONDENSING AND EVAPORATING HEAT EXCHANGERS

CROSS-REFERENCE TO RELATED APPLICATION

The present application is a divisional of U.S. patent application Ser. No. 16/691,816 filed Nov. 22, 2019, entitled COMBINATION WASHING/DRYING LAUNDRY APPLIANCE HAVING A HEAT PUMP SYSTEM WITH REVERSIBLE CONDENSING AND EVAPORATING HEAT EXCHANGERS, now U.S. Pat. No. 11,299,834, which is a divisional of U.S. patent application Ser. No. 15/293,813 filed Oct. 14, 2016, entitled COMBINATION WASHING/DRYING LAUNDRY APPLIANCE HAVING A HEAT PUMP SYSTEM WITH REVERSIBLE CONDENSING AND EVAPORATING HEAT EXCHANGERS, now U.S. Pat. No. 10,519,591, the entire disclosures of which are hereby incorporated herein by reference.

FIELD OF THE DEVICE

The device is in the field of washing and drying appliances, and more specifically, a combination washing and drying laundry appliance having a refrigeration circuit that is reversible for alternating the functions of the heat exchangers of the refrigerant circuit.

SUMMARY

In at least one aspect, a laundry appliance includes a rotating drum for receiving items to be processed. An airflow path selectively directs a flow of process air across a first heat exchanger in a drying condition and a washing condition. The drying condition is defined by the process air being directed through the rotating drum and through a third heat exchanger. The washing condition is defined by the process air being directed away from the third heat exchanger. A fluid path selectively directs fluid through a second heat exchanger in the drying and washing conditions. The drying condition is further defined by the fluid being selectively directed through the third heat exchanger to intersect with the process air. The washing condition is further defined by the fluid being selectively directed to the rotating drum. A reversible refrigerant circuit directs a refrigerant between the first and second heat exchangers, the reversible refrigerant circuit having a flow control valve that further defines the drying and washing conditions of the reversible refrigerant circuit. The drying condition is further defined by the first heat exchanger being a heater for the process air and the second heat exchanger being a cooling module for the fluid. The washing condition is further defined by the first heat exchanger being a cooling module for the process air and the second heat exchanger being a heater for the fluid, wherein the fluid and the process air intersect with one another at the third heat exchanger in the drying condition.

In at least another aspect, an air/water handling system for an appliance includes a rotating drum, an airflow path having a blower for directing process air through the airflow path, a fluid path having a pump for directing a fluid through the fluid path, a first heat exchanger in direct engagement with the airflow path, a second heat exchanger in direct engagement with the fluid path and a reversible refrigerant circuit that delivers a refrigerant through the first and second heat exchangers. The reversible refrigerant circuit selectively and alternatively defines a washing condition wherein the first heat exchanger is an evaporator that cools the process air to define cooled process air, and the second heat exchanger is a condenser that heats the fluid to define a heated fluid that is directed into the rotating drum, and a drying condition wherein the first heat exchanger is the condenser that heats the process air to define heated process air that is directed through the rotating drum and through a third heat exchanger, and the second heat exchanger is the evaporator that cools the fluid to define a cooled fluid that is directed to the third heat exchanger to intersect with the heated process air.

In at least another aspect, a laundry appliance includes a heat pump system having first and second heat exchangers and a reversible refrigerant loop that delivers a refrigerant to the first and second heat exchangers. A control selectively and alternatively operates the heat pump system between washing and drying conditions. The washing condition is defined by the first and second heat exchangers being a cooling module and a heater, respectively. The drying condition is defined by the first and second heat exchangers being a heater and a cooling module, respectively. An airflow path is in direct communication with the first heat exchanger and the control to define the washing and drying conditions within the airflow path. A fluid path is in direct communication with the second heat exchanger and the control to define the washing and drying conditions within the fluid path. The washing condition is defined by the fluid path moving a fluid across the second heat exchanger to define a heated fluid that is directed to a processing chamber. The drying condition is defined by the airflow path directing process air across the first heat exchanger to define heated process air that is directed through the processing chamber and through a third heat exchanger. The drying condition is further defined by the fluid path moving the fluid across the second heat exchanger to define a cooled fluid that is directed to the third heat exchanger to intersect with the heated process air.

These and other features, advantages, and objects of the present device will be further understood and appreciated by those skilled in the art upon studying the following specification, claims, and appended drawings.

DETAILED DESCRIPTION OF EMBODIMENTS

Figure 1:
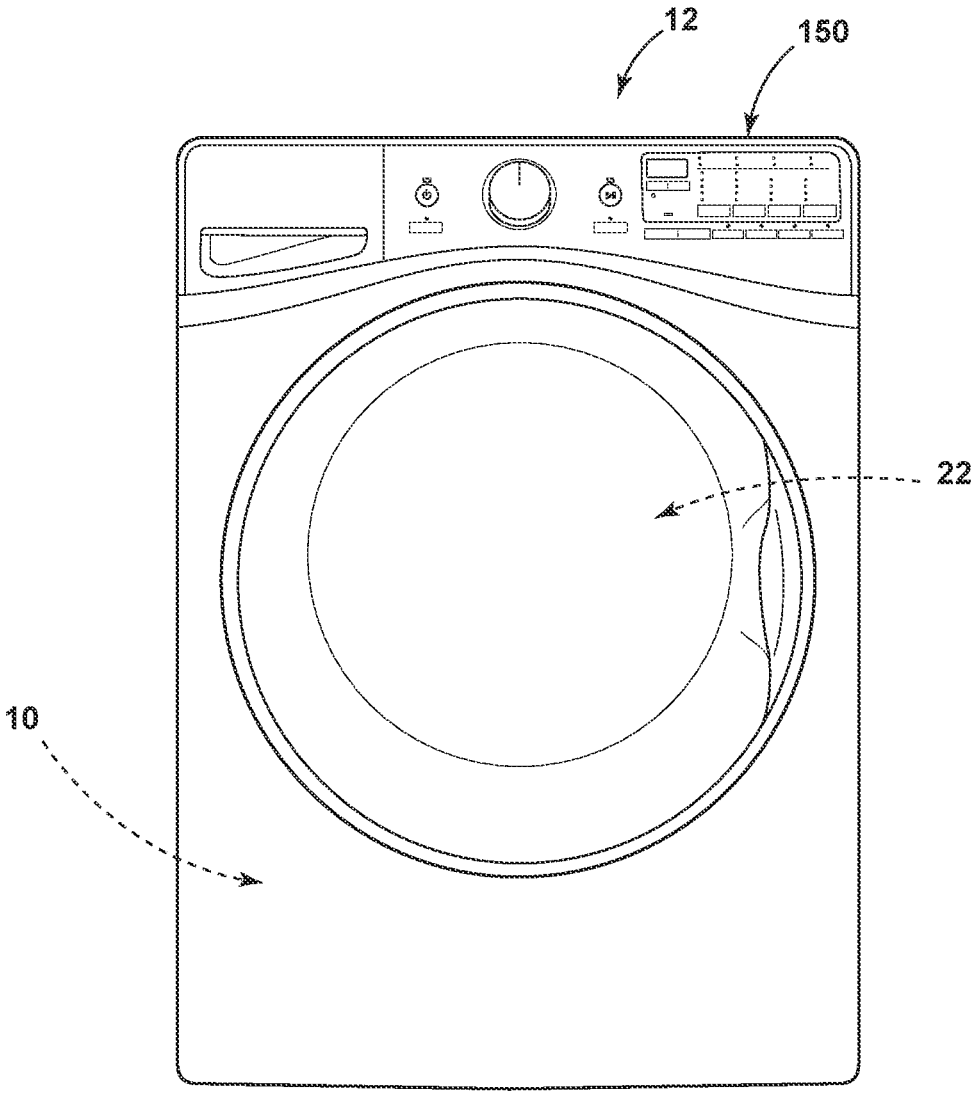
FIG. 1 is a front elevational view of a laundry appliance incorporating an aspect of the reversible heat pump system.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-8, reference numeral 10 generally refers to a reversible heat pump system 10 for use in an appliance 12, such as a combination washing/drying laundry appliance 12. The reversible heat pump system 10 for the laundry appliance 12 can be used for transferring heat energy 14 from one portion of the appliance 12 to another portion of the appliance 12 for the performance of various temperature-related functions. These functions can include heating and/or cooling various materials within the appliance 12 such as process air 16, fluid 18, a refrigerant 20, and other similar thermal exchange materials.

According to the various embodiments, as exemplified in FIGS. 1-6, the laundry appliance 12 can include a rotating drum 22 for receiving items 24 to be processed. Such items 24 can include, but are not limited to, fabric, clothing, other wearable items 24, and other similar things typically cleaned within the laundry appliance 12. An airflow path 26 is disposed within the laundry appliance 12 and selectively directs a flow of process air 16 across a first heat exchanger 28 in a drying condition 30 and a washing condition 32. It is contemplated that the drying condition 30 is defined by the process air 16 being directed through the rotating drum 22 and through a shower area in the form of a third heat exchanger 34. The washing condition 32 of the airflow path 26 is defined by the process air 16 being directed away from the rotating drum 22 and/or the third heat exchanger 34. The laundry appliance 12 can also include a fluid path 36 that selectively directs fluid 18 through a second heat exchanger 38 in the drying and washing conditions 30, 32. Through the fluid path 36, the drying condition 30 is further defined by the fluid 18 being selectively directed through the third heat exchanger 34 to intersect with the process air 16. The washing condition 32 with respect to the fluid path 36 is further defined by the fluid 18 being selectively directed to the rotating drum 22.

Referring again to FIGS. 1-8, to operate the heat exchange functions of the appliance 12, a reversible refrigerant circuit 50 is adapted to direct a refrigerant 20 between the first and second heat exchangers 28, 38. The reversible refrigerant circuit 50 includes a flow control valve 52 that directs the flow of the refrigerant 20 in first and second directions 54, 56, to further define the drying and washing conditions 30, 32, respectively, of the reversible refrigerant circuit 50, as well as the airflow and fluid paths 26, 36. With regard to the reversible refrigerant circuit 50, the drying condition 30 is defined by the first heat exchanger 28 being a heater, such as a condenser 58, for the process air 16 and the second heat exchanger 38 being a cooling module, such as an evaporator 60, for the fluid 18. Conversely, when the reversible refrigerant circuit 50 is reversed by the flow control valve 52, the washing condition 32 is defined by the first heat exchanger 28 being the cooling module, or evaporator 60, for the process air 16 and the second heat exchanger 38 being a heater, or condenser 58, for the fluid 18. It is contemplated that in the drying condition 30, the fluid 18 and the process air 16 intersect with one another at the third heat exchanger 34. In this manner, the moisture condensation and particulate filtration mechanisms 68, 70 can be separated from the first and second heat exchangers 28, 38. It is contemplated that the reversible refrigerant circuit 50 is free of direct contact with the third heat exchanger 34. This configuration serves to limit the amount of particulate matter 62 that adheres to the first and second heat exchangers 28, 38 in the drying condition 30.

Referring again to FIGS. 4-6, when the laundry appliance 12 is in the drying condition 30, the third heat exchanger 34 defines a particulate filtration mechanism 70 and simultaneously defines a moisture condensation mechanism 68. Through these mechanisms, the third heat exchanger 34 is adapted to simultaneously remove particulate matter 62 and condense and remove moisture 72 from the process air 16 as the heated process air 74 is mixed with the cooled fluid 76 within the third heat exchanger 34. According to various embodiments, the particulate filtration mechanism 70 and the moisture condensation mechanism 68 can be defined by a fluid sprayer 78 that is disposed proximate the third heat exchanger 34. The fluid sprayer 78 is adapted to selectively shower or otherwise deliver the cooled fluid 76 from the second heat exchanger 38. In the drying condition 30, the second heat exchanger 38 serves as a cooling module that extracts heat energy 14 from the fluid 18 as the refrigerant 20 changes phases within the second heat exchanger 38. After heat energy 14 is extracted from the fluid 18, the fluid 18 defines the cooled fluid 76 that is delivered to the fluid sprayer 78 of the third heat exchanger 34. The fluid sprayer 78 selectively delivers the cooled fluid 76 to intersect with a heated process air 74 delivered from the first heat exchanger 28.

Referring again to FIGS. 4-6, in the drying condition 30, the first heat exchanger 28 defines a heater, such as a condenser 58, whereby heat energy 14 is radiated or otherwise given off from the refrigerant 20 within the first heat exchanger 28 and delivered to the process air 16 passing through the airflow path 26. Because the airflow path 26 is in direct communication with the first heat exchanger 28, the heat energy 14 radiated from the refrigerant 20 is delivered to the process air 16 to define the heated process air 74. This heated process air 74 is delivered through the rotating drum 22 and then to the third heat exchanger 34. As will be described more fully below, as the heated process air 74 passes through the rotating drum 22, moisture 72 from damp or wet items 24 disposed within the rotating drum 22 can be entrapped within the heated process air 74 to define moisture-laden process air 90. In addition to moisture 72, the moisture-laden process air 90 can also accumulate particulate matter 62 that is captured from the items 24 being processed within the rotating drum 22. This particulate matter 62 is typically in the form of lint, fluff, other fibrous material, various particles, and other similar particulate matter 62 typically seen within laundry drying appliances 12.

Referring again to FIGS. 4-6, as the moisture-laden process air 90 is delivered to the third heat exchanger 34, the cooled fluid 76 is delivered from the fluid sprayer 78 and travels through the moisture-laden process air 90. The combination of the heated moisture-laden process air 90 and the cooled fluid 76 causes an exchange of heat energy 14 from the process air 16 to the fluid 18 that cools and dehumidifies the moisture-laden process air 90. This exchange of heat energy 14 causes a condensation and removal of the moisture within the moisture-laden process air 90, where this precipitated moisture 72 is captured by the cooled fluid 76. The cooled fluid 76 delivered from the fluid sprayer 78 also captures all or substantially all of the particulate matter 62 contained within the process air 16. In this manner, the process air 16 leaving the third heat exchanger 34 defines cooled return air 92, being substantially free of particulate matter 62, that is returned to the first heat exchanger 28 to be reheated for further performance of the various drying functions of the appliance 12. The fluid 18 leaving the third heat exchanger 34 defines a heated return fluid 94 that contains the captured moisture 72 and captured particulate matter 62 from the moisture-laden process air 90. The heated return fluid 94 is then delivered back toward a fluid tank 96 and/or the second heat exchanger 38. The particulate matter 62 can be removed from the heated return fluid 94, and the fluid 18 is then cooled through the second heat exchanger 38 to be returned to the third heat exchanger 34 for further filtration and condensing of additional moisture-laden process air 90.

Figure 2:
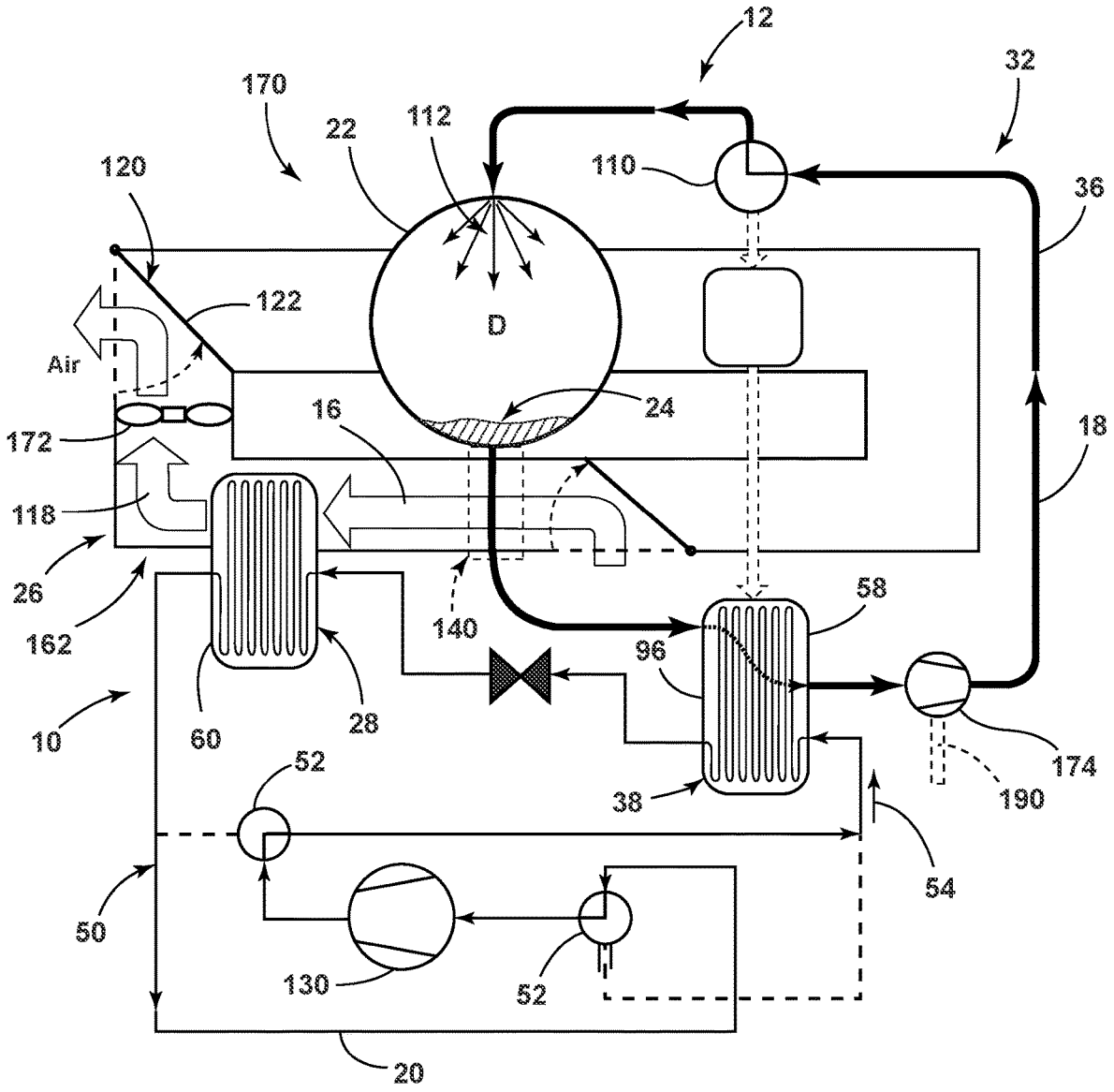
FIG. 2 is a schematic diagram illustrating an aspect of the reversible heat pump system disposed in a washing condition.
Figure 3:
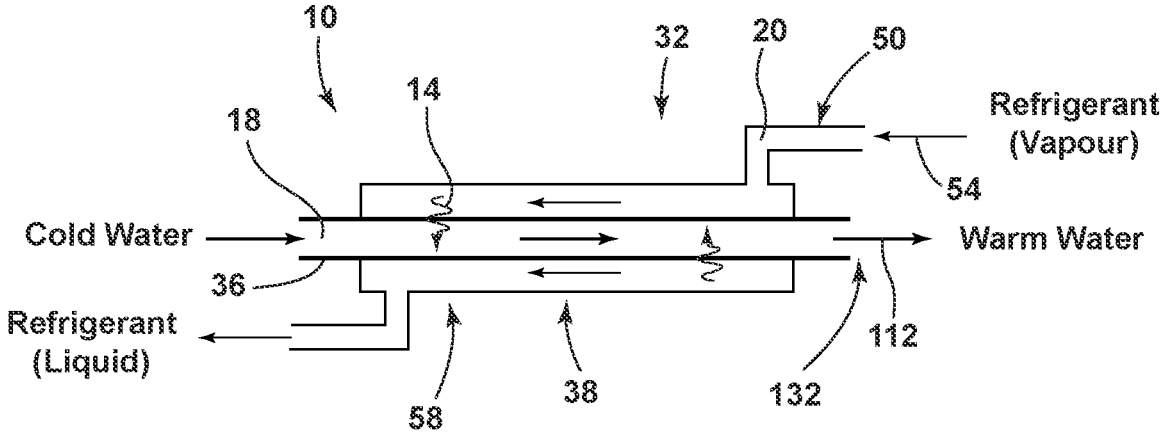
FIG. 3 is a schematic diagram illustrating an aspect of the second heat exchanger of the appliance of FIG. 2.

Referring now to FIGS. 2 and 3, the washing condition 32 of the appliance 12 is defined by a fluid diverter valve 110 within the fluid path 36 modifying the flow of the fluid 18 to be into the rotating drum 22, rather than the third heat exchanger 34. As discussed above, the washing condition 32 of the appliance 12 is defined by the second heat exchanger 38, which is in communication with the fluid 18 and the fluid path 36, being a heater that is adapted to define heated fluid 112 that is delivered to the rotating drum 22. Accordingly, fluid 18 heated through the reversible heat pump system 10 can be delivered to the rotating drum 22 for adding heated fluid 112 to the combination washing/drying appliance 12. The fluid diverter valve 110 can be in the form of a two-way valve that alternates the flow of the fluid 18 between the third heat exchanger 34 and the rotating drum 22.

Referring again to FIGS. 2 and 3, the washing condition 32 of the appliance 12 is further defined by the first heat exchanger 28 being an evaporator 60 that is adapted to decrease the air temperature of the process air 16 of the airflow path 26 to define cooled process air 118. In the washing condition 32, one of the functions of the first heat exchanger 28, being a cooling module in the washing condition 32, is to remove heat energy 14 from the system for purposes of allowing the condenser 58, in the form of the second heat exchanger 38, to properly heat the fluid 18 for delivery to the rotating drum 22. To perform this function, the airflow path 26 includes an air diverting system 120 in the form of at least one air deflector 122 that blocks the process air 16 from entering at least one of the rotating drum 22 and the third heat exchanger 34. Typically, the process air 16 in the washing condition 32 will be redirected by the air deflectors 122 from entering either of the rotating drum 22 or the third heat exchanger 34. Accordingly, in the washing condition 32, the airflow path 26 defines a generally linear and non-recirculating airflow path 26 that delivers air through the first heat exchanger 28 in the form of an evaporator 60. This process air 16 is then cooled and delivered away from the first heat exchanger 28, typically out of the appliance 12 altogether.

It is contemplated that various aspects of the appliance 12 can include a recirculation of the cooled process air 118 into another portion of the appliance 12. Such cooled process air 118 leaving the evaporator 60 in the washing condition 32 can be used for cooling various portions of the appliance 12. Such cooling functions can include, but are not limited to, cooling a compressor 130 or making fine adjustments to the fluid temperature 132 of the heated fluid 112 leaving the second heat exchanger 38. It is also contemplated that the cooled process air 118 can be delivered to an area outside of the appliance 12 for cooling an area or a fixture proximate the combination washing/drying appliance 12, or other similar cooling functions for a household and/or commercial cooling function.

Referring again to FIGS. 2 and 3, in the washing condition 32, as process air 16 is moved toward the evaporator 60, it is contemplated that a portion of the heated fluid 112 delivered to the drum 22 can be used as a secondary fluid shower 140 for removing particulate matter 62 that may be contained within the process air 16 as it approaches the first heat exchanger 28 in the form of the evaporator 60. This secondary fluid shower 140 may also heat the process air 16, thereby providing the process air 16 with additional capacity for extracting heat from the evaporator 60. This additional capacity for extracting heat energy 14 from the evaporator 60 can serve to make the reversible heat pump system 10 more efficient during its operation. The secondary fluid shower 140, in addition to potentially increasing the thermal capacity to accept heat energy 14 from the evaporator 60, also removes particulate matter 62 from the process air 16. In this manner, particulate matter 62 can be removed from the process air 16 before reaching the first heat exchanger 28. This particulate matter 62 is thereby removed before the particulate matter 62 can adhere to portions of the evaporator 60. Accordingly, the secondary fluid shower 140 can serve as a secondary particulate filtration mechanism 70 for preventing the accumulation of particulate matter 62 on the first heat exchanger 28 in the washing condition 32.

Referring again to FIGS. 1-8, in order to control the reversible refrigerant circuit 50, the fluid diverter valve 110 and the air diverting system 120, the appliance 12 can include a control 150 in communication with these components. It is contemplated that the control 150 selectively and alternatively defines the washing and drying conditions 32, 30 within each of the reversible refrigerant circuit 50, the fluid path 36 and the airflow path 26. Accordingly, the washing and drying conditions 32, 30 can be simultaneously alternated such that the reversible refrigerant circuit 50, the fluid path 36 and the airflow path 26 are in communication and collectively modified between the washing and drying conditions 32, 30 through operation of the control 150.

Referring again to FIGS. 1-8, according to the various embodiments, the airflow path 26 is adapted to be free of direct engagement with the second heat exchanger 38 at least in the drying condition 30 and typically in both the washing and drying conditions 32, 30. The fluid path 36 of the appliance 12 is adapted to be free of direct engagement with the first heat exchanger 28 in each of the washing and drying conditions 32, 30. Also, the reversible refrigerant circuit 50 is free of engagement with the third heat exchanger 34. In the drying condition 30, it is contemplated that the reversible refrigerant circuit 50 is in indirect thermal communication with the third heat exchanger 34 through operation of the fluid path 36 and airflow path 26, as described above during operation of the drying condition 30.

Figure 4:
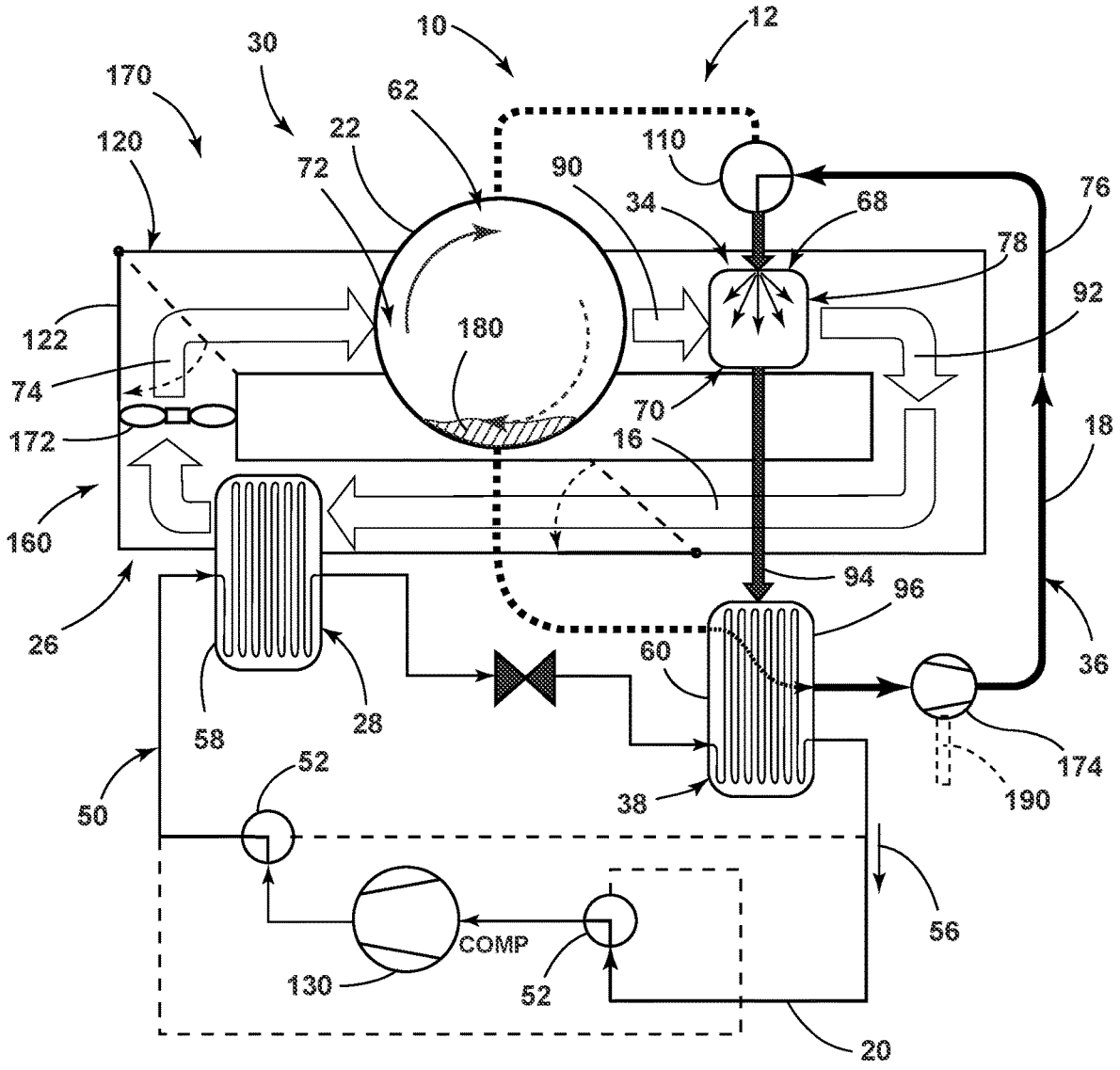
FIG. 4 is a schematic diagram of the appliance of FIG. 2 showing the heat pump system in a drying condition.
Figure 5:
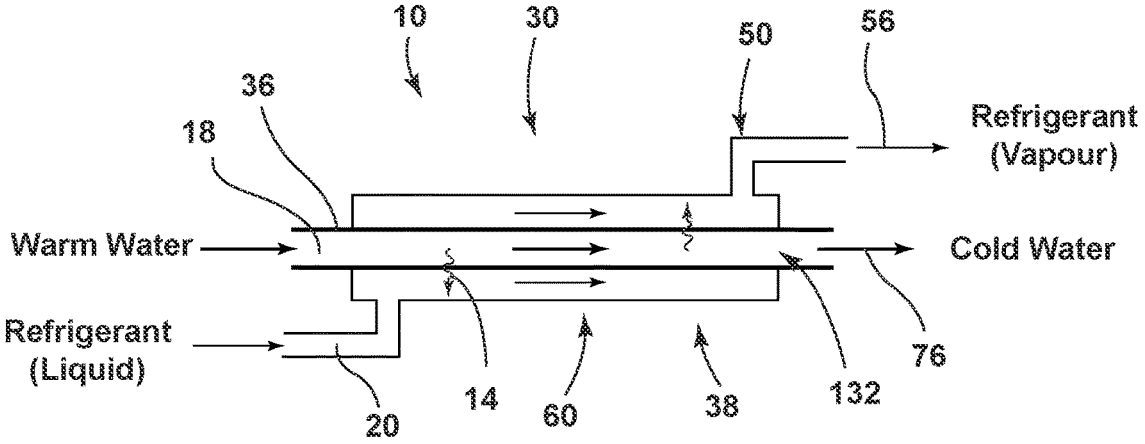
FIG. 5 is a schematic diagram illustrating an aspect of the second heat exchanger of FIG. 4 shown in the drying condition.
Figure 6:
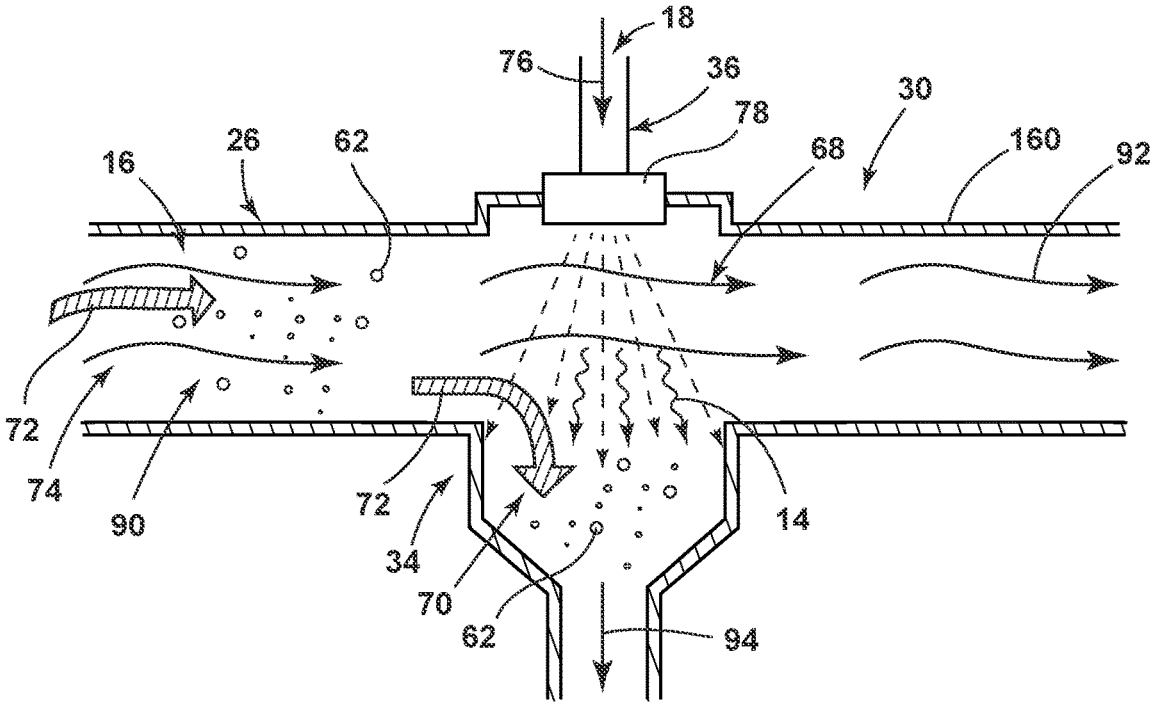
FIG. 6 is a schematic diagram illustrating an aspect of the third heat exchanger of the appliance disposed in the drying condition.
Figure 7:
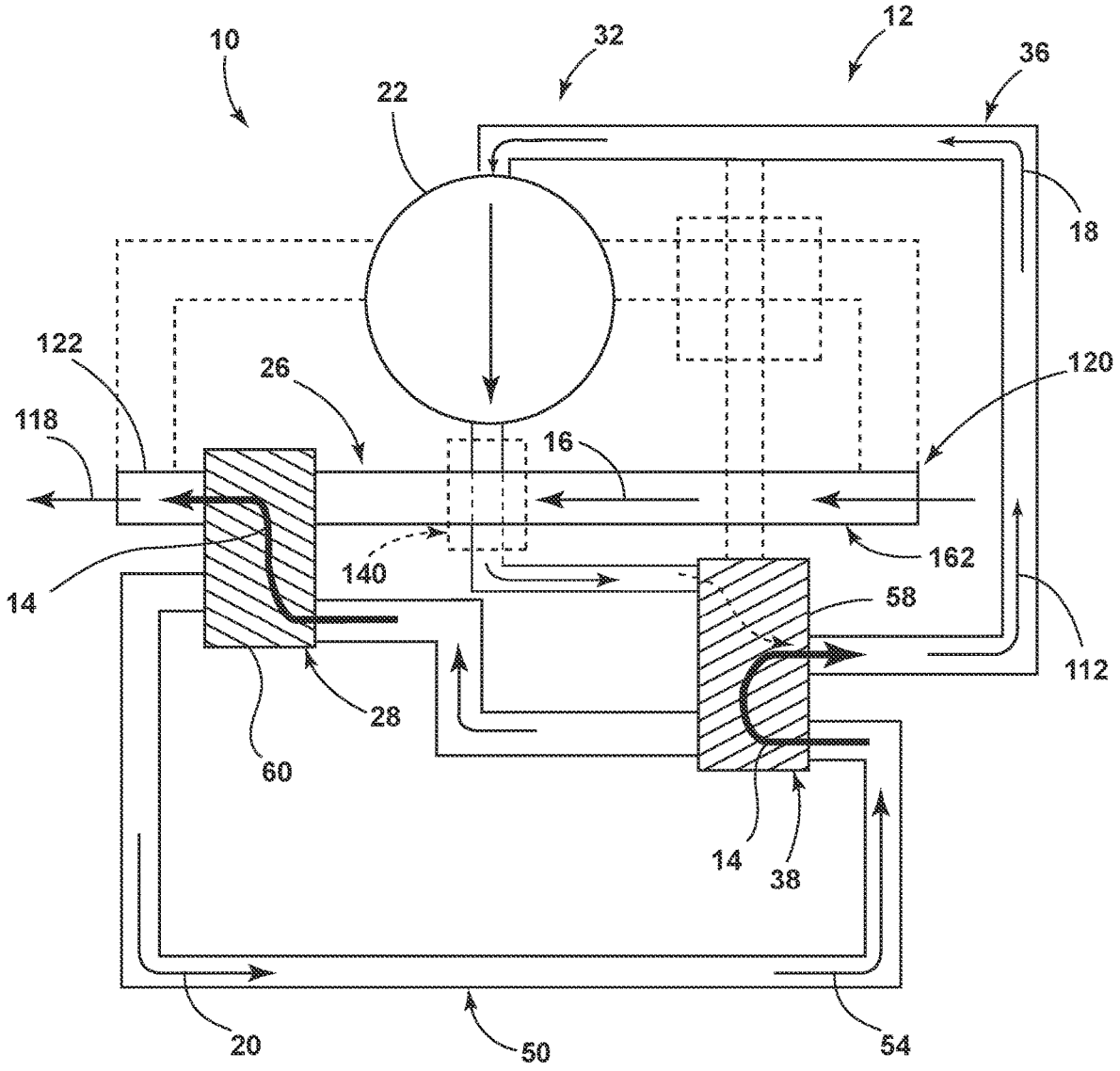
FIG. 7 is a schematic diagram illustrating a heat exchange system of the appliance of FIG. 2 in the washing condition.
Figure 8:
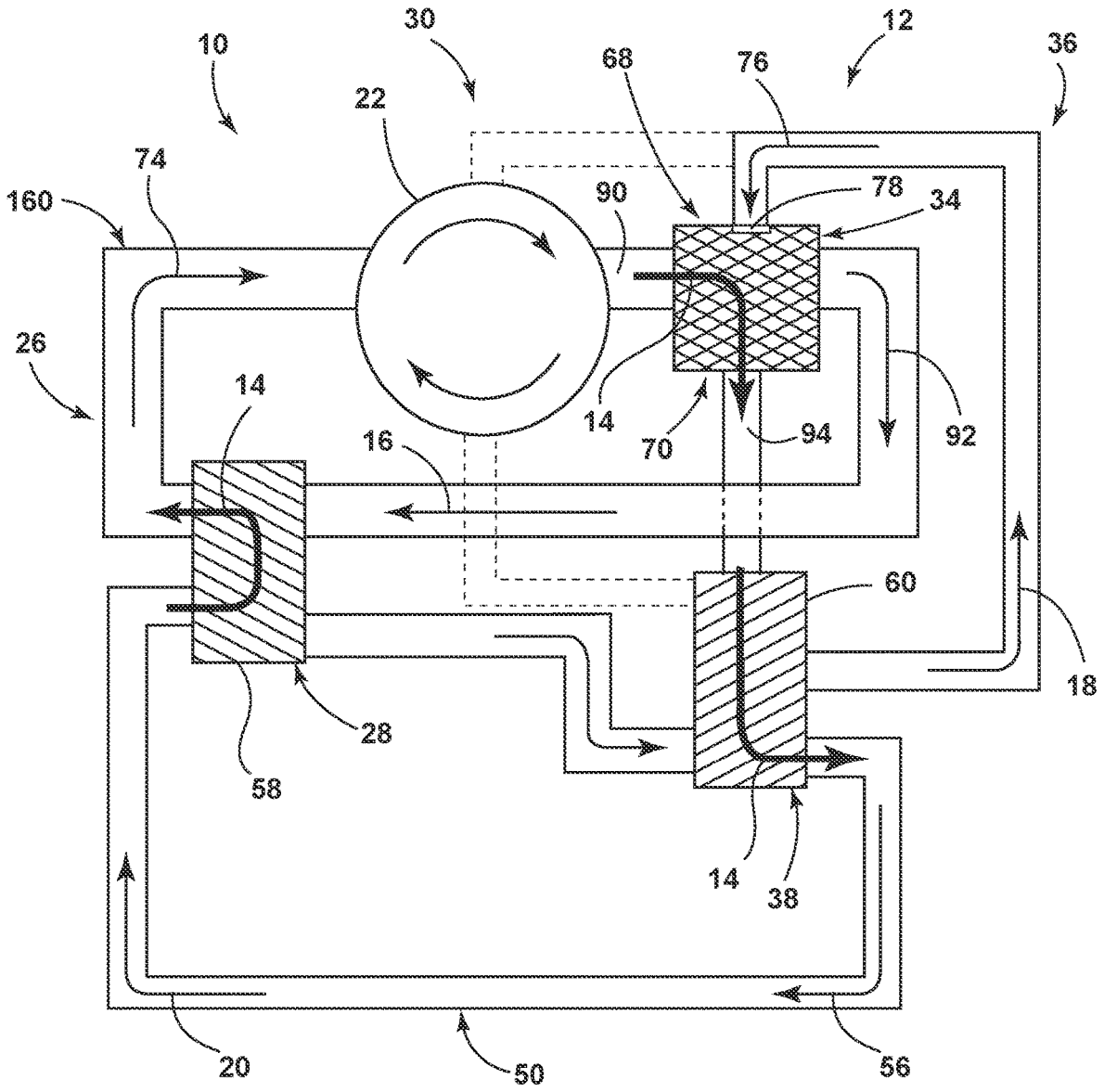
FIG. 8 is a schematic diagram illustrating a heat exchange mechanism of the appliance of FIG. 4 in the drying condition.
Figure 9:
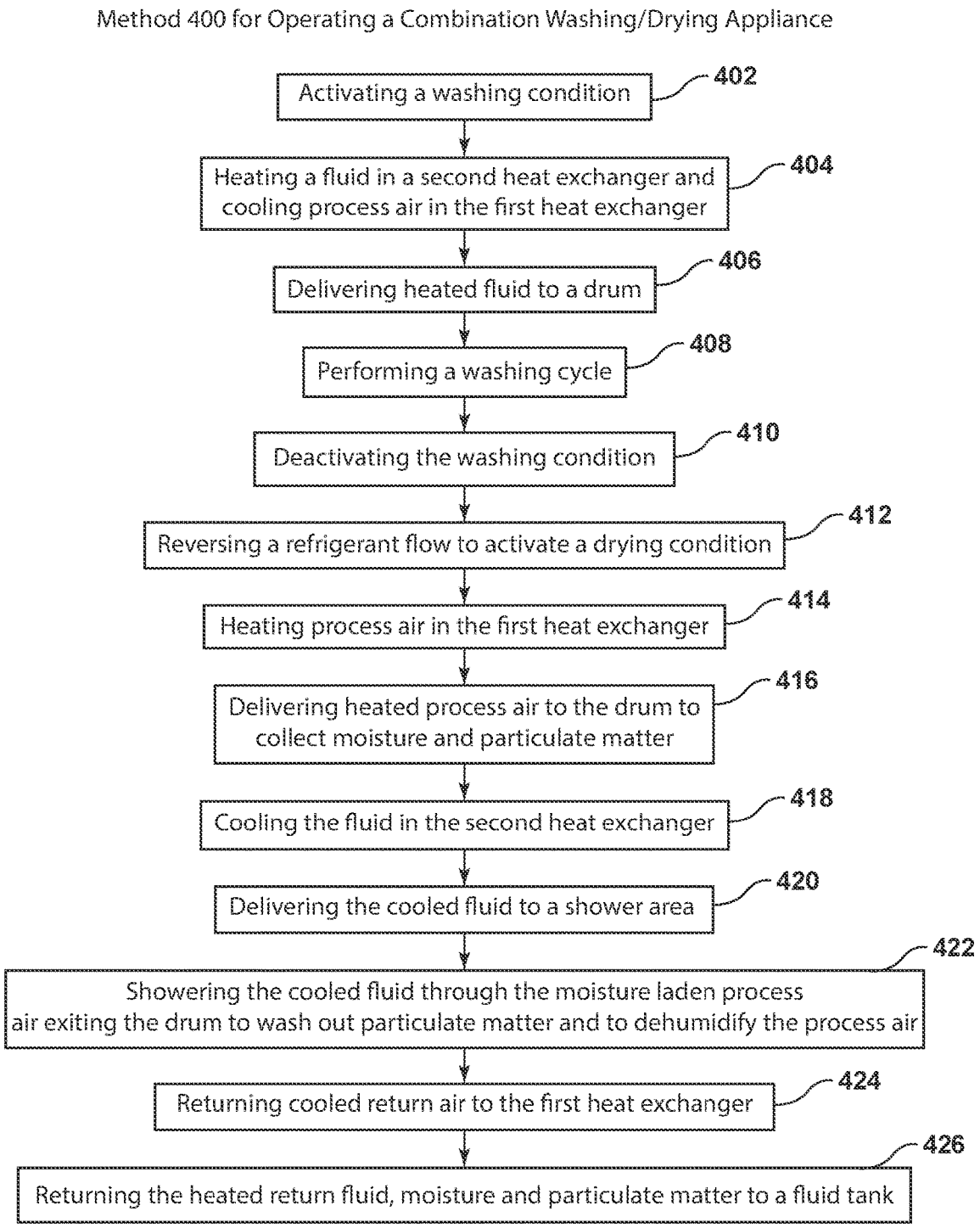
FIG. 9 is a schematic flow diagram illustrating a method for operating a combination washing and drying laundry appliance utilizing a reversible heat pump system.

In the drying condition 30, as exemplified in FIGS. 4-6, it is contemplated that the airflow path 26, through operation of the air deflectors 122, defines a recirculating drying path 160 that recirculates process air 16 from the first heat exchanger 28, through the rotating drum 22 and through the third heat exchanger 34, such that each of these components are positioned along the recirculating drying path 160. Alternatively, in the washing condition 32, the airflow path 26 is modified through the one or more air deflectors 122 to define a non-recirculating cooling flow path 162 through the first heat exchanger 28 that carries the process air 16 away from the rotating drum 22 and also away from the third heat exchanger 34.

Referring again to FIGS. 1-8, an air/water handling system 170 can be disposed within the appliance 12. It is contemplated that the air/water handling system 170 can include the rotating drum 22, and the airflow path 26 that includes a blower 172 for directing process air 16 through the airflow path 26. A fluid path 36 is included, where the fluid path 36 includes a pump 174 for directing a fluid 18 through at least a portion of the fluid path 36. The first heat exchanger 28 is positioned to be in direct engagement with the airflow path 26. The second heat exchanger 38 is positioned to be in direct engagement with the fluid path 36. The reversible refrigerant circuit 50 serves to deliver a refrigerant 20 through the first and second heat exchangers 28, 38. It is contemplated that the reversible refrigerant circuit 50 selectively and alternatively defines the washing condition 32 where the first heat exchanger 28 is an evaporator 60 that cools the process air 16. As the process air 16 leaves the evaporator 60 of the first heat exchanger 28, this process air 16 defines cooled process air 118. The second heat exchanger 38, in the washing condition 32, defines a condenser 58 that heats the fluid 18 to define heated fluid 112 that is directed into the rotating drum 22. The reversible refrigerant circuit 50 includes a flow control valve 52 that reverses the flow of the refrigerant 20 between the first and second directions 54, 56 to define, alternatively, the washing and drying conditions 32, 30, respectively.

In the drying condition 30 of the reversible refrigerant circuit 50, the first heat exchanger 28 is a condenser 58 that heats the process air 16 to define heated process air 74. This heated process air 74 is directed through the rotating drum 22 and through the third heat exchanger 34. The second heat exchanger 38 in the drying condition 30 is defined as an evaporator 60. In the drying condition 30, the evaporator 60 serves to cool the fluid 18 to define the cooled fluid 76 that is directed to the third heat exchanger 34. This cooled fluid 76 delivered to the third heat exchanger 34 is adapted to intersect with the heated process air 74. The third heat exchanger 34 delivers the cooled fluid 76 to a fluid sprayer 78 that directs the cooled fluid 76 through the heated process air 74, as described above. The cooled fluid 76 serves to decrease the air temperature of the heated process air 74 while also wetting and capturing particulate matter 62 within the heated process air 74. The wet particulate matter 62, being heavier, is allowed to fall from the moisture-laden process air 90 and is captured or wasted away with the heated return fluid 94. In this manner, the intermingling of the cooled fluid 76 with the heated process air 74 defines moisture condensation and particulate filtration mechanisms 68, 70 within the third heat exchanger 34. Simultaneously, the heated process air 74 increases a fluid temperature 132 of the cooled fluid 76. As the heat energy 14 is transferred from the heated process air 74 to the cooled fluid 76, the precipitation of moisture 72 occurs to condense and remove moisture 72 that may be contained within the heated process air 74 as it moves through the third heat exchanger 34.

Referring now to FIGS. 1-9, having described various aspects of the combination washing/drying appliance 12 that utilizes the reversible heat pump system 10, a method 400 is disclosed for operating a combination washing/drying laundry appliance 12. According to the method 400, where items 24, such as fabric or clothing, are disposed in the rotating drum 22 to be washed and dried by the washing and drying laundry appliance 12, the washing condition 32 of the heat pump system 10 is activated (step 402). As discussed above, the washing condition 32 is characterized by the first heat exchanger 28 defining an evaporator 60 that is adapted to be in direct engagement with the airflow path 26. The washing condition 32 of the airflow path 26 is defined by the air diverting system 120 to deliver process air 16 across the first heat exchanger 28 and away from the rotating drum 22. As discussed above, the process air 16 in the washing condition 32 is adapted to allow for the transfer of heat energy 14 from the evaporator 60 to the process air 16 for expulsion away from the evaporator 60. The washing condition 32 is further characterized by the second heat exchanger 38 defining a condenser 58 coupled to the first heat exchanger 28 via the reversible refrigerant circuit 50. In the washing condition 32, the refrigerant 20 of the reversible refrigerant circuit 50 is adapted to flow in a first direction 54 through operation of the flow control valve 52.

According to the method 400, after the washing condition 32 is activated, a fluid 18 disposed within the fluid path 36 is heated (step 404). This fluid 18 can be delivered to the fluid path 36 via an external fluid source such as a wall spigot. Alternatively, the fluid 18 within the fluid path 36 can be stored fluid 18 from a previous laundry cycle that can be recirculated for use in subsequent laundry cycles. It is contemplated that the second heat exchanger 38, being a condenser 58 in the washing condition 32, heats the fluid 18 to a predetermined temperature.

According to the various embodiments, it is contemplated that the condenser 58 in the washing condition 32 can be adapted to heat the fluid 18 to a certain temperature according to each performance of the washing condition 32. This heated fluid 112 can then be mixed with cool external tap water or cooled and stored water to achieve a particular temperature. It is also contemplated that the fluid 18 can be moved through the condenser 58 at a particular rate, such that a predetermined rate of heating is experienced by the fluid 18 moving through the condenser 58 in order to achieve a predetermined temperature.

By way of example, and not limitation, fluid 18 moving slowly through the condenser 58 may receive greater amounts of heat energy 14 from the condenser 58 and therefore reach a higher predetermined fluid temperature 132. Conversely, fluid 18 moving through the condenser 58 at a faster rate may receive lesser amounts of heat energy 14 and may therefore achieve a lesser or lower fluid temperature 132. In this manner, the operation of the fluid pump 174 can vary the flow rate of the fluid 18 to also vary the fluid temperature 132 of the heated fluid 112.

Referring again to FIGS. 1-9, once the fluid 18 is heated, the heated fluid 112 is delivered to the rotating drum 22 (step 406). The heated fluid 112 enters the rotating drum 22 and soaks the one or more items 24 disposed within the rotating drum 22. It is contemplated that during a particular washing condition 32, the heated fluid 112 can be mixed with various washing fluids 18, such as detergent, fabric softener, bleach, oxi-substances, and other laundry-related products. The heated fluid 112 and various laundry-related products serve to soak the at least one item within the rotating drum 22. After being soaked, various washing conditions 32 are performed with respect to the at least one item within the rotating drum 22 (step 408). As the washing condition 32 is performed, the at least one item becomes a damp item 180 disposed within the rotating drum 22.

It is contemplated that the washing condition 32 can include various washing cycles. These washing cycles can include, but are not limited to, agitation cycles, rinse cycles, spin cycles, steaming cycles, sanitizing cycles, soak cycles, and other similar washing-related laundry cycles. In the case of a steam-washing cycle, the fluid 18 can be moved through the condenser 58 at a particularly slow rate such that at least a portion of the fluid 18 is heated to above the boiling point of water to achieve a gaseous state (i.e., steam). This gaseous form of a portion of the heated fluid 112 can be injected into the rotating drum 22 for the performance of various sanitizing functions of the laundry appliance 12. After the various washing cycles are completed, the washing condition 32 of the heat pump system 10 is deactivated (step 410).

Referring again to FIGS. 1-9, according to the method 400, after the washing condition 32 is complete, the flow of the refrigerant 20 in the reversible refrigerant cycle is reversed from the first direction 54 to the second direction 56 through operation of the flow control valve 52 (step 412). The flow of refrigerant 20 in the second direction 56 activates the drying condition 30 of the heat pump system 10. As discussed above, the drying condition 30 of the heat pump system 10 is characterized by the first heat exchanger 28 being a condenser 58 that is in direct engagement with the airflow path 26. Additionally, the airflow path 26 defines a recirculating path that delivers process air 16 through the rotating drum 22, the third heat exchanger 34 and the first heat exchanger 28, sequentially. The second heat exchanger 38 in the drying condition 30 defines an evaporator 60 in direct engagement with the fluid path 36, where the fluid path 36 defines a recirculating path that delivers the fluid 18 from the second heat exchanger 38 to the fluid sprayer 78 of the third heat exchanger 34.

According to the method 400, during operation of the drying condition 30, process air 16 is delivered to the first heat exchanger 28 to define heated process air 74 (step 414). This heated process air 74 is then delivered to the at least one damp item 180 within the rotating drum 22. The heated process air 74 mingles with the damp item 180 to capture at least a portion of the moisture 72 and a portion of the particulate matter 62 from the damp item 180 to define moisture-laden process air 90 that is then delivered out of the rotating drum 22. The moisture-laden process air 90 is then delivered to the third heat exchanger 34 (step 416).

Referring again to FIGS. 1-9, simultaneous, or substantially simultaneous to the formation of the heated process air 74, cooled fluid 76 is formed by delivering at least a portion of the fluid 18 through the second heat exchanger 38 in the form of the evaporator 60 (step 418). This cooled fluid 76 is then delivered to the fluid sprayer 78 of the third heat exchanger 34 (step 420). Within the third heat exchanger 34, the cooled fluid 76 is sprayed through the moisture-laden process air 90 as the moisture-laden process air 90 moves through the third heat exchanger 34 (step 422).

According to the various embodiments, as exemplified in FIGS. 1-9, within the third heat exchanger 34, the cooled fluid 76 decreases the air temperature of a moisture-laden process air 90 to condense and precipitate at least a portion of the moisture 72 therefrom and also capture at least a portion of the particulate matter 62. Accordingly, the cooled fluid 76 changes the moisture-laden process air 90 into cooled return air 92 that has a lower amount of moisture 72 and also little, if any, particulate matter 62 contained therein. The moisture-laden process air 90 also serves to increase the temperature of the cooled fluid 76 to define a heated return fluid 94. The heated return fluid 94 contains at least a portion of the moisture 72 and particulate matter 62 from the moisture-laden process air 90 that was included therein.

According to the method 400, after the heat exchange operation within the third heat exchanger 34, the cooled return air 92 is returned through the airflow path 26 back to the first heat exchanger 28 (step 424). In this manner, the cooled return air 92 is returned to the first heat exchanger 28 and is substantially free of particulate matter 62. In this manner, the third heat exchanger 34 serves as a particulate filtration mechanism 70 that removes particulate matter 62 from the process air 16. This particulate matter 62 is then retained within the heated return fluid 94. In this manner, particulate matter 62 does not adhere or substantially adhere to or become entrapped within the first heat exchanger 28 during operation of the drying condition 30. The heated return fluid 94, moisture 72 and particulate matter 62 are returned to a fluid tank 96 (step 426).

According to the various embodiments, as exemplified in FIGS. 1-9, it is contemplated that the heated return fluid 94 and moisture 72 can be recirculated across the second heat exchanger 38 for re-use as cooled fluid 76 for delivery back to the third heat exchanger 34. The fluid tank 96 can include a particulate removal system that entraps and removes particulate matter 62 removed from the moisture-laden process air 90. This entrapped particulate matter 62 can ultimately be expelled from the appliance 12 and through a drain pump and/or drain outlet 190 for removal from the appliance 12. After an appropriate amount of moisture 72 has been removed from the damp item 180 within the rotating drum 22, the drying condition 30 is completed (step 428). The fluid 18, moisture 72 and particulate matter 62 can thereby be delivered to a drain outlet 190 for expulsion from the appliance 12. As discussed above, it is contemplated that, in various embodiments, the fluid 18 and moisture 72 can be recirculated for use in a later washing cycle.

Through the use of the reversible heat pump system 10 used in conjunction with the first, second and third heat exchangers 28, 38, 34, the first, second and third heat exchangers 28, 38, 34 can be used for heating and cooling functions related to the process air 16 and fluid 18. The heat energy 14 transferred through the first and second heat exchangers 28, 38 can then be delivered to various portions of the appliance 12 for performing various filtration, condensation, washing and drying functions of the appliance 12. Through the use of this reversible heat pump system 10, particulate matter 62 is maintained separate from the first and second heat exchangers 28, 38 such that particulate matter 62 does not become entrapped within the coil structures first and second heat exchangers 28, 38. Rather, the particulate matter 62 is removed through the intermingling of process air 16 and fluid 18 within the third heat exchanger 34. While the particulate matter 62 is removed at a location physically separated from the first and second heat exchangers 28, 38, heat energy 14 transferred between the first and second heat exchangers 28, 38 is utilized to operate the third heat exchanger 34. Accordingly, delivery of heat energy 14 through the first, second and third heat exchangers 28, 38, 34 allows for operation of the washing and drying conditions 32, 30 of the appliance 12.

According to the various embodiments, this particulate matter 62 is removed and remains separate from the first and second heat exchangers 28, 38 without the need for a physical filter in the form of a screen, mesh, foam, or other similar blocking-type filter. Without the need for a blocking-type filter, the filterless system described herein can be maintenance free or substantially maintenance free with respect to the removal of particulate matter 62 from the various systems of the appliance 12.

According to the various embodiments, it is contemplated that the reversible refrigerant circuit 50 can be any one of various refrigerant circuits. By way of example, and not limitation, the reversible refrigerant circuit 50 can include a compressor 130, expansion device, refrigerant line with the refrigerant 20 disposed therein, and a flow control valve 52 that serves to reverse the flow of refrigerant 20 through the refrigerant line. The refrigerant 20 contained within the reversible refrigerant circuit 50 can include, but are not limited to, Freon, water, and other similar phase change materials that can be used within various refrigeration and/or heat pump systems 10.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A laundry appliance comprising:

a heat pump system having first and second heat exchangers and a reversible refrigerant loop that delivers a refrigerant to the first and second heat exchangers;

a control that selectively and alternatively operates the heat pump system between washing and drying conditions, the washing condition defined by the first and second heat exchangers being a cooling module and a heater, respectively, the drying condition defined by the first and second heat exchangers being the heater and the cooling module, respectively;

an airflow path in direct communication with the first heat exchanger and the control to define the washing and drying conditions within the airflow path; and a fluid path in direct communication with the second heat exchanger and the control to define the washing and drying conditions within the fluid path, wherein:

the washing condition is defined by the fluid path moving a fluid across the second heat exchanger to define a heated fluid that is directed to a processing chamber;

the drying condition is defined by the airflow path directing process air across the first heat exchanger to define heated process air that is directed through the processing chamber and through a third heat exchanger; and the drying condition is further defined by the fluid path moving the fluid across the second heat exchanger to define a cooled fluid that is directed to the third heat exchanger to intersect with the heated process air.

2. The laundry appliance of claim 1, wherein the fluid path includes a fluid diverter valve in communication with the control to modify the fluid path between the washing and drying conditions and the airflow path includes an air diverting system in communication with the control to modify the airflow path between the washing and drying conditions.

3. The laundry appliance of claim 2, wherein the air diverting system is defined by at least one air deflector that redirects the heated process air away from at least one of the processing chamber and the third heat exchanger.

4. The laundry appliance of claim 2, wherein the fluid diverter valve and the air diverting system operate contemporaneously to modify the fluid path and the airflow path, respectively, between the washing condition and the drying condition.

5. The laundry appliance of claim 1, wherein the first heat exchanger is free of direct contact with the fluid path in both of the washing and drying conditions and the second heat exchanger is free of direct contact with the airflow path at least in the drying condition.

6. The laundry appliance of claim 1, wherein the third heat exchanger defines a moisture condensation mechanism defined by intersection of the cooled fluid with the heated process air lowering an air temperature of the heated process air to condense and remove entrapped moisture from the heated process air.

7. The laundry appliance of claim 6, wherein the third heat exchanger further defines a particulate filtration mechanism wherein the cooled fluid within the third heat exchanger is adapted to entrap particulate matter carried within the heated process air.

8. The laundry appliance of claim 7, wherein the cooled fluid is configured to capture the particulate matter from the heated process air, and wherein the cooled fluid moves the particulate matter through at least a portion of the fluid path.

9. The laundry appliance of claim 6, wherein the third heat exchanger is a shower area that is in communication with the fluid path and the airflow path.

10. A laundry appliance comprising:

a rotating drum for receiving items to be processed, the rotating drum defining drying and washing conditions;

a blower that directs a flow of process air through an airflow path and across a first heat exchanger, wherein the drying condition is defined by the process air being directed through the rotating drum and through a shower area, and the washing condition is defined by the process air being directed away from the shower area;

a fluid path that selectively directs fluid through a second heat exchanger, the drying condition further defined by the fluid being selectively directed through the shower area to intersect with the process air, and the washing condition further defined by the fluid being selectively directed to the rotating drum; and a reversible refrigerant circuit that directs a refrigerant between the first and second heat exchangers, the drying condition defined by the first heat exchanger being a heater for the process air and the second heat exchanger being a cooling module for the fluid, the washing condition defined by the first heat exchanger being a cooling module for the process air and the second heat exchanger being a heater for the fluid, wherein the process air is free of direct engagement with the second heat exchanger at least in the drying condition, the fluid path is free of direct engagement with the first heat exchanger in each of the washing and drying conditions, and the reversible refrigerant circuit is free of engagement with a third heat exchanger that includes the shower area.

11. The laundry appliance of claim 10, wherein the shower area in the drying condition defines a filtration and moisture condensation mechanism for removing moisture and particulate matter from the process air within the third heat exchanger.

12. The laundry appliance of claim 11, wherein the fluid is configured to capture the particulate matter from the process air, and wherein the fluid moves the particulate matter through at least a portion of the fluid path.

13. The laundry appliance of claim 10, further comprising:

a control in communication with the reversible refrigerant circuit, wherein the control is also in communication with a fluid diverter valve of the fluid path and an air diverting system of the airflow path to selectively and alternatively define the washing and drying conditions in each of the reversible refrigerant circuit, the fluid path and the airflow path.

14. The laundry appliance of claim 13, wherein the air diverting system is defined by at least one air deflector operable within the airflow path that is operable within the airflow path to define the washing and drying conditions.

15. The laundry appliance of claim 13, wherein the fluid diverter valve and the air diverting system operate contemporaneously to modify the fluid path and the airflow path, respectively, between the washing condition and the drying condition.

16. The laundry appliance of claim 10, wherein the reversible refrigerant circuit, the fluid path and the airflow path are in communication to be collectively modified between the washing and drying conditions.

17. A laundry appliance comprising:

a blower that directs process air along an airflow path;

a pump that directs fluid along a fluid path;

a first heat exchanger in direct engagement with the process air;

a second heat exchanger in direct engagement with the fluid; and a reversible refrigerant circuit that delivers a refrigerant through the first and second heat exchangers in a first direction and in a second direction to selectively and alternatively define:

a washing condition wherein the first heat exchanger cools the process air to define cooled process air, and the second heat exchanger heats the fluid to define a heated fluid that is directed into a processing space for saturating articles to be processed; and a drying condition wherein the first heat exchanger heats the process air to define heated process air that is directed sequentially through the processing space for drying the articles and through a shower area, and the second heat exchanger cools the fluid to define a cooled fluid that is directed to the shower area to intersect with the heated process air to wash particulate matter out of the heated process air leaving the processing space, wherein the shower area delivers the cooled fluid to intersect with the heated process air, wherein the fluid within the shower area captures moisture and the particulate matter from the heated process air for delivery through the fluid path.

18. The laundry appliance of claim 17, wherein the shower area includes fluid sprayer that directs the cooled fluid through the heated process air.

19. The laundry appliance of claim 17, further comprising:

a control in communication with the reversible refrigerant circuit, wherein the control is also in communication with a fluid diverter valve of the fluid path and an air diverting system of the airflow path to selectively and alternatively define the washing condition and the drying condition in each of the reversible refrigerant circuit, the fluid path and the airflow path.

20. The laundry appliance of claim 19, wherein the fluid diverter valve and the air diverting system operate contemporaneously to modify the fluid path and the airflow path, respectively, between the washing condition and the drying condition.

* * * * *